US007487858B2

(12) United States Patent
Kawahashi et al.

(10) Patent No.: US 7,487,858 B2
(45) Date of Patent: Feb. 10, 2009

(54) ACOUSTIC FLUID MACHINE

(75) Inventors: Masaaki Kawahashi, Saitama (JP); Tamotsu Fujioka, Yokohama (JP); Mohammed Anwar Hossain, Yokohama (JP); Masayuki Saito, Cincinnati, OH (US)

(73) Assignee: Anest Iwata Corporation, Yokohama-shi (JP)

( * ) Notice: Subject to any disclaimer, the term of this patent is extended or adjusted under 35 U.S.C. 154(b) by 123 days.

(21) Appl. No.: 11/875,269

(22) Filed: Oct. 19, 2007

(65) Prior Publication Data

US 2008/0041658 A1 Feb. 21, 2008

Related U.S. Application Data

(62) Division of application No. 11/162,300, filed on Sep. 6, 2005, now abandoned.

(30) Foreign Application Priority Data

Sep. 10, 2004 (JP) ..... 2004-263654

(51) Int. Cl.
*F01N 1/14* (2006.01)

(52) U.S. Cl. ..... 181/262; 60/508

(58) Field of Classification Search ..... 181/262, 181/252, 220, 259, 250, 266, 276, 277, 278, 181/271, 198
See application file for complete search history.

(56) References Cited

U.S. PATENT DOCUMENTS

| | | | |
|---|---|---|---|
| 1,896,080 | A | 2/1933 | Hampson |
| 5,515,684 | A | 5/1996 | Lucas et al. |
| 5,913,938 | A | 6/1999 | Brooks |
| 5,994,854 | A | 11/1999 | Lawrenson et al. |
| 6,230,420 | B1 | 5/2001 | Lawrenson et al. |
| 6,247,354 | B1 | 6/2001 | Vig et al. |
| 6,530,236 | B2 | 3/2003 | Crane et al. |
| 6,679,399 | B2 | 1/2004 | Franjo et al. |
| 2005/0013704 | A1 | 1/2005 | Dyson et al. |
| 2006/0037812 | A1 | 2/2006 | Kawahashi et al. |

FOREIGN PATENT DOCUMENTS

JP 2004-116309 4/2004

*Primary Examiner*—Lincoln Donovan
*Assistant Examiner*—Forrest Phillips

(57) ABSTRACT

In an acoustic resonator, an actuator allows a piston to reciprocate axially at very small amplitude at high speed. Owing to pressure fluctuation in the acoustic resonator involved by reciprocal motion of the piston, fluid is sucked into and discharged from the acoustic resonator via a valve device at the top end of the acoustic resonator. The acoustic resonator is covered with a gas guide with a space. The valve device is cooled by a fan at the top end of the gas guide.

4 Claims, 7 Drawing Sheets

ACOUSTIC FLUID MACHINE

This application is a continuation of application Ser. No. 11/162,300 filed Sep. 6, 2005 which is based on Japanese Application No. 2004-263654 filed Sep. 10, 2004.

BACKGROUND OF THE INVENTION

The present invention relates to an acoustic fluid machine to keep temperature gradient as small as possible between the base having an actuator for an acoustic resonator and the top end having a valve device for sucking and discharge.

Japanese Patent Pub. No. 2004-116309A corresponding to U.S. patent application Ser. No. 10/922,383 filed Aug. 19, 2004 discloses an acoustic fluid machine in which an actuator that has a piston is provided at the base of a tapered acoustic resonator for creating in-tube wave motion with acoustic resonation, and a valve device for sucking and discharging fluid with pressure fluctuation therein.

In the acoustic fluid machine, only when fluid temperature is within a certain range, the shape and size of the acoustic resonator enables the optimum resonation frequency to be produced, thereby carrying out the optimum sucking and discharge of the fluid. Should resonation frequency be out of the predetermined range, compression ratio becomes smaller, making it impossible to obtain a desired discharge pressure.

The resonation frequency varies with change in temperature of the resonator. Thus, calculation of the resonation frequency allows frequency of the actuator of the piston to vary to match the calculated resonation frequency thereby exhibiting a desired sucking/discharge.

Accordingly, it is necessary to use arithmetic equipment to control the actuator of the piston, which makes its structure complicate and involves high cost.

Temperature in the acoustic resonator of the acoustic fluid machine is high at the generally-closed top end or a valve device, while it is low at the generally-opening piston and actuator therefor to increase temperature gradient. If temperature gradient in the acoustic resonator is as small as possible, the determined resonation frequency will be within a normal compression area without deviation or with slight deviation.

SUMMARY OF THE INVENTION

In view of the foregoing disadvantages, it is an object of the present invention to provide an acoustic fluid machine in which temperature gradient between the base and the top end of an acoustic resonator is kept as small as possible.

BRIEF DESCRIPTION OF THE DRAWINGS

The features and advantages of the invention will become more apparent from the following description with respect to embodiments as shown in accompanying drawings wherein.

DETAILED DESCRIPTION OF PREFERRED EMBODIMENTS

Figure 1:
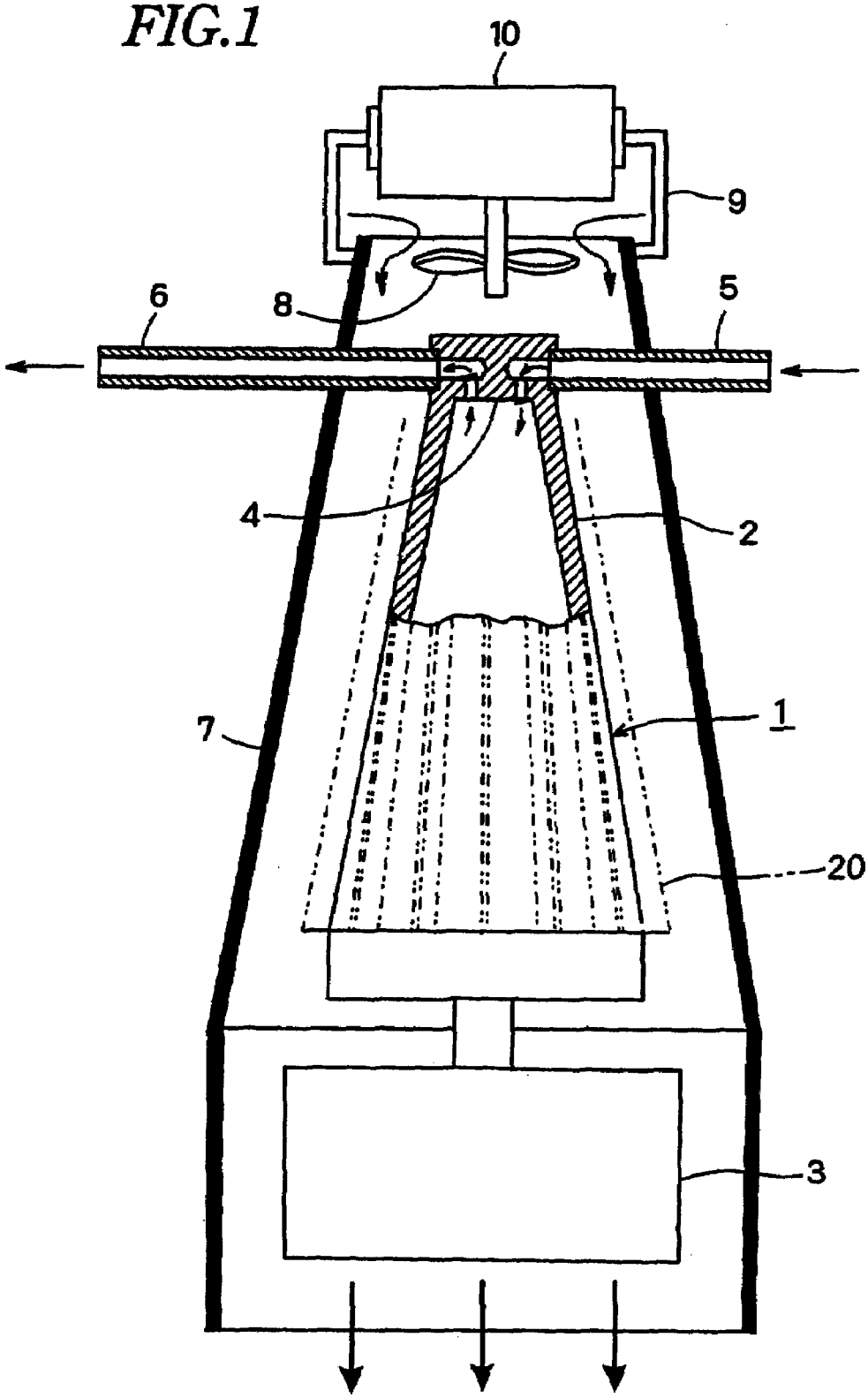
FIG. 1 is a vertical sectional front view of an embodiment of an acoustic fluid machine according to the present invention.

Numeral 1 denotes an acoustic fluid machine in which an acoustic resonator 2 has an actuator 3 in a larger-diameter base. A piston (not shown) is reciprocated axially at high speed at very small amplitude. Owing to pressure fluctuation in the acoustic resonator 2 involved by reciprocal motion of the piston, air and other fluid are sucked into the acoustic resonator 2 through a sucking pipe 5 and discharged from a discharge pipe 6.

The acoustic fluid machine 1 is contained with a space in a gas guide 7 that opens at the top end and the base end. A fan 8 is provided inside the top end of the gas guide 7.

FIG. 1 shows that the fan 8 is driven by an electric motor 10 mounted to the outer surface of the top end of the gas guide 7 by a bracket 9.

Figure 2:
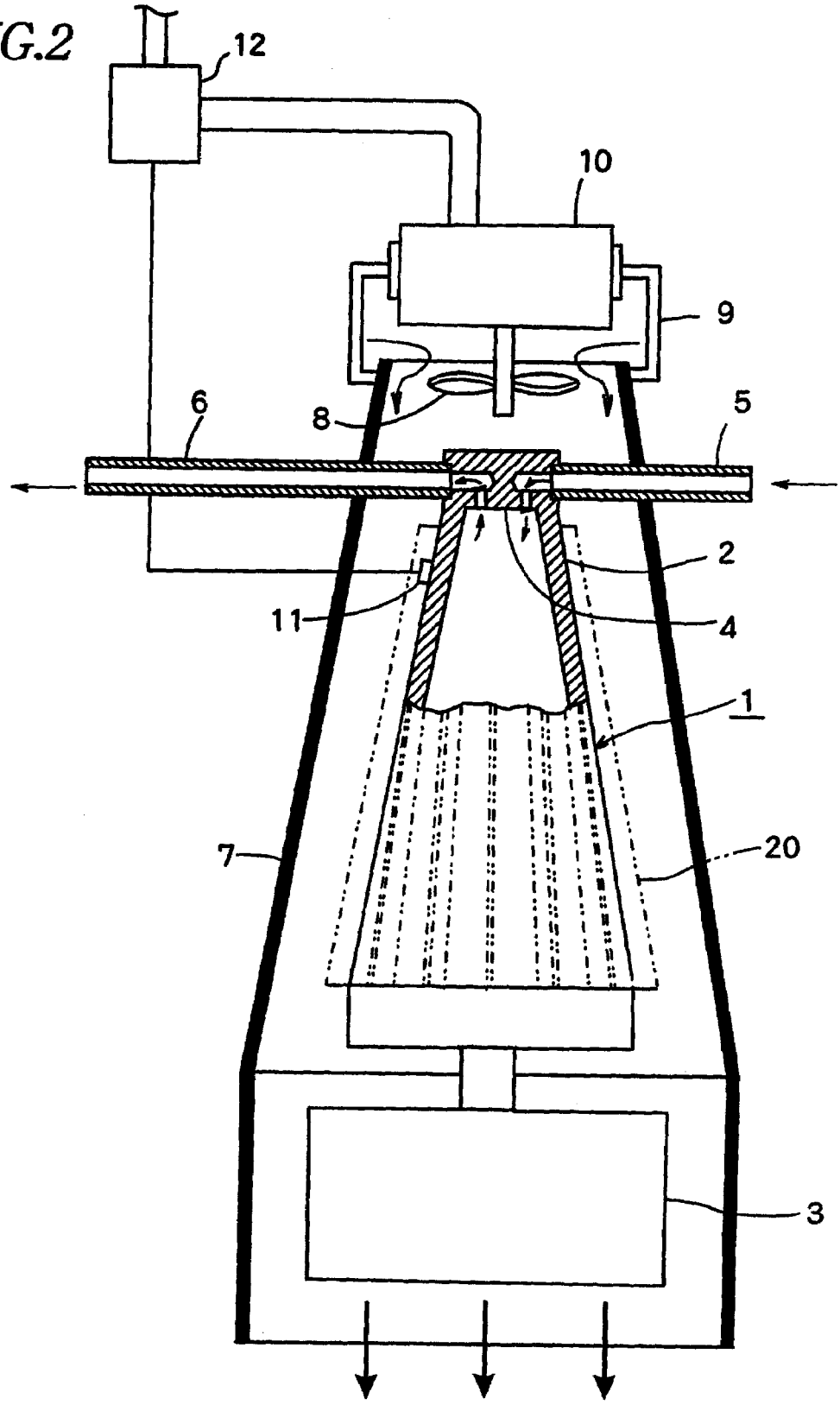
FIG. 2 is a vertical sectional front view of another embodiment of an acoustic fluid machine according to the present invention.

FIG. 2 shows that a control unit 12 allows electricity supplied into the electric motor 10 in FIG. 1 to vary depending on detected temperature of a temperature sensor 11 in the acoustic resonator 2. Thus, the quantity of air supplied by a fan is allowed to vary depending on temperature of the acoustic resonator 2.

Figure 3:
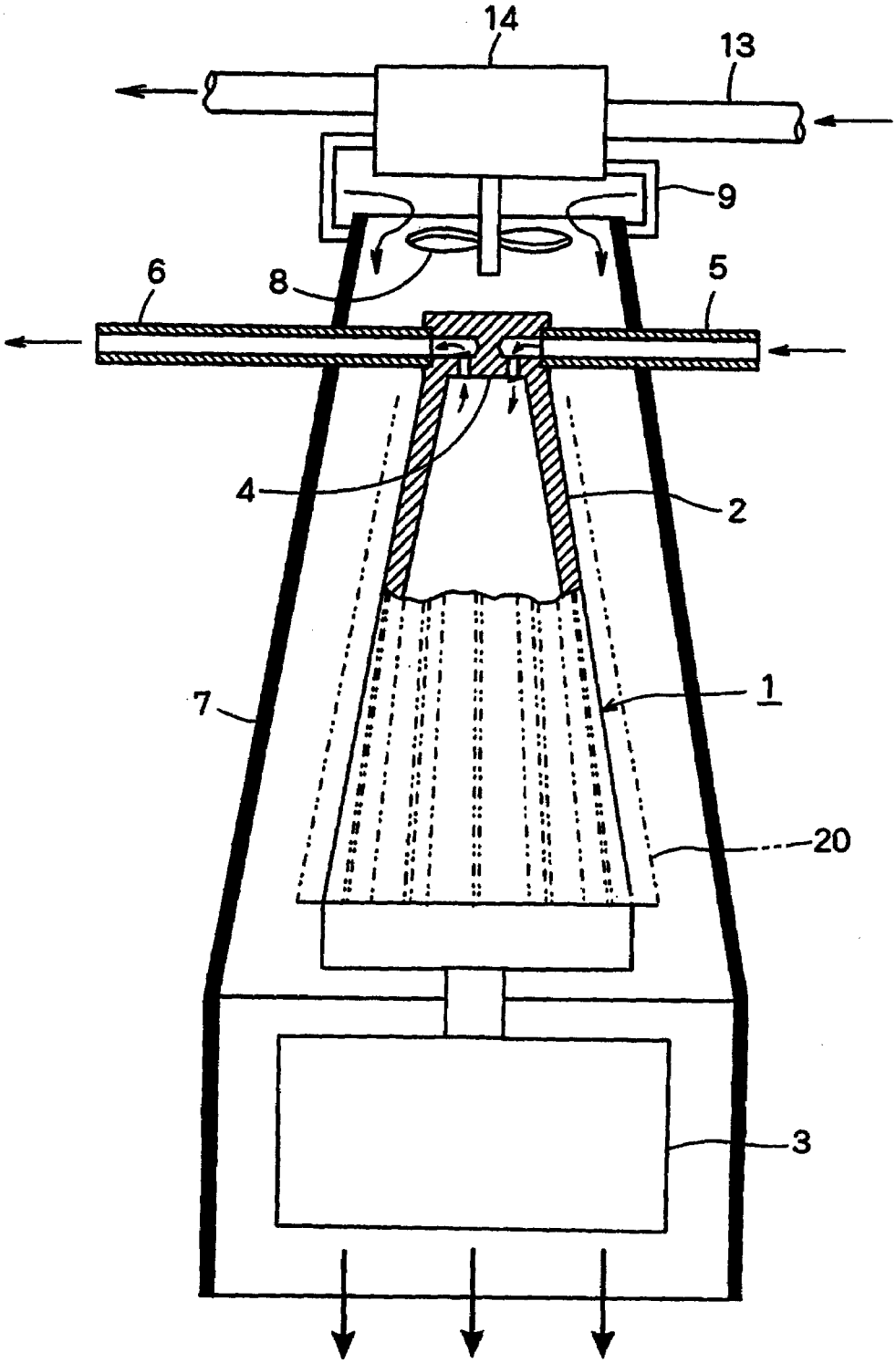
FIG. 3 is a vertical sectional front view of still another embodiment of an acoustic fluid machine according to the present invention.

FIG. 3 shows that the fan 8 is driven by a compressed-air-actuating turbine 14 via an air tube 13.

Figure 4:
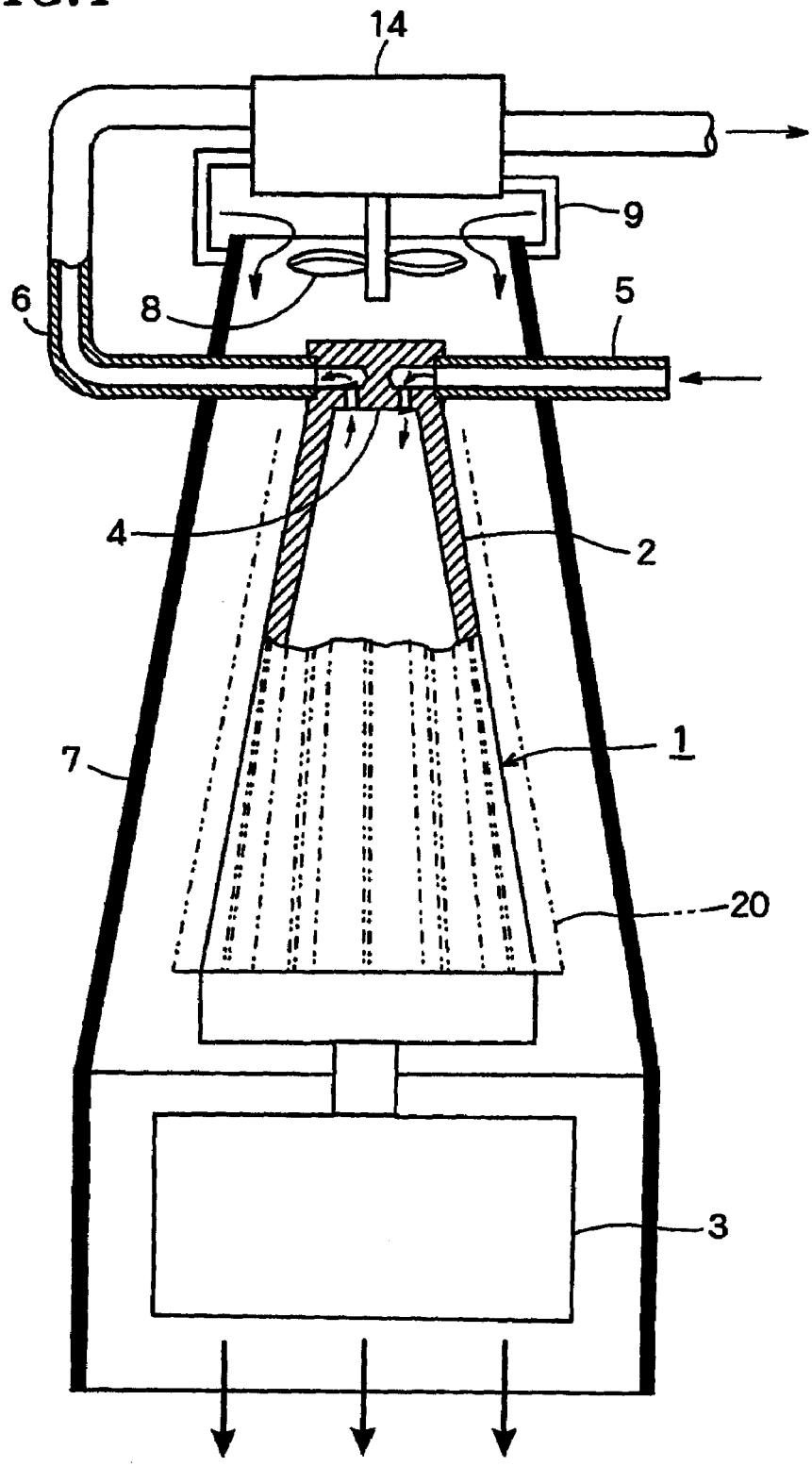
FIG. 4 is a vertical sectional front view of yet another embodiment of an acoustic fluid machine according to the present invention.

FIG. 4 shows that the compressed-air-actuating turbine 14 is driven by pressurized air sucked from the sucking pipe 5 and discharged from the discharge pipe 6 via a valve device 4. The pressurized air from the compressed-air-actuating turbine 14 is thus employed for primary purpose.

Figure 5:
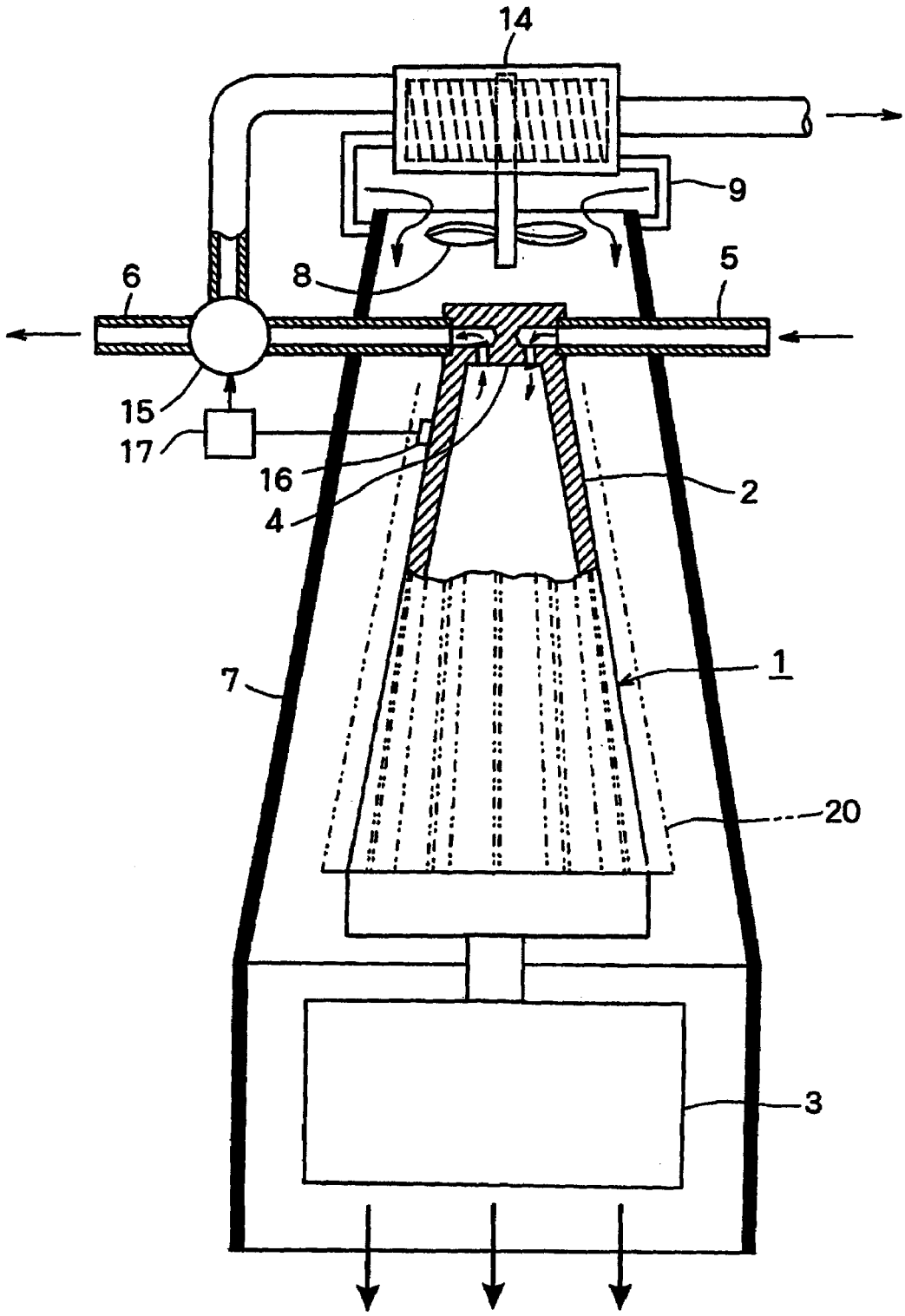
FIG. 5 is a vertical sectional front view of a further embodiment of an acoustic fluid machine according to the present invention.

In FIG. 5, the pressurized air discharged from the valve device 4 is forwarded to the compressed-air-actuating turbine 14 via a regulating valve 15, and the control unit 17 allows the degree of opening of the regulating valve 15 to be controlled on the basis of the temperature sensor 16 on the acoustic resonator 2.

Figure 6:
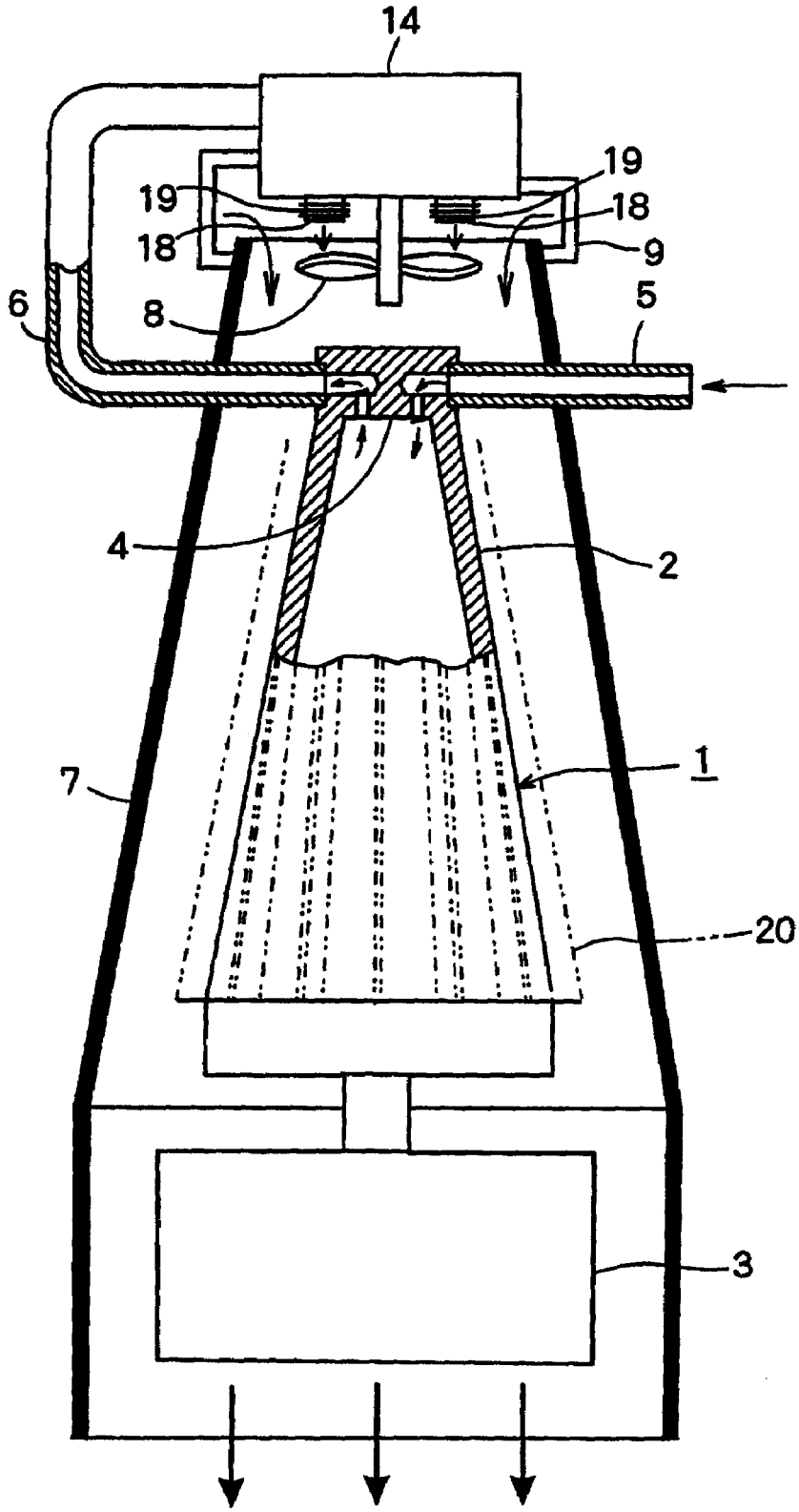
FIG. 6 is a vertical sectional front view of a still further embodiment of an acoustic fluid machine according to the present invention.
Figure 7:
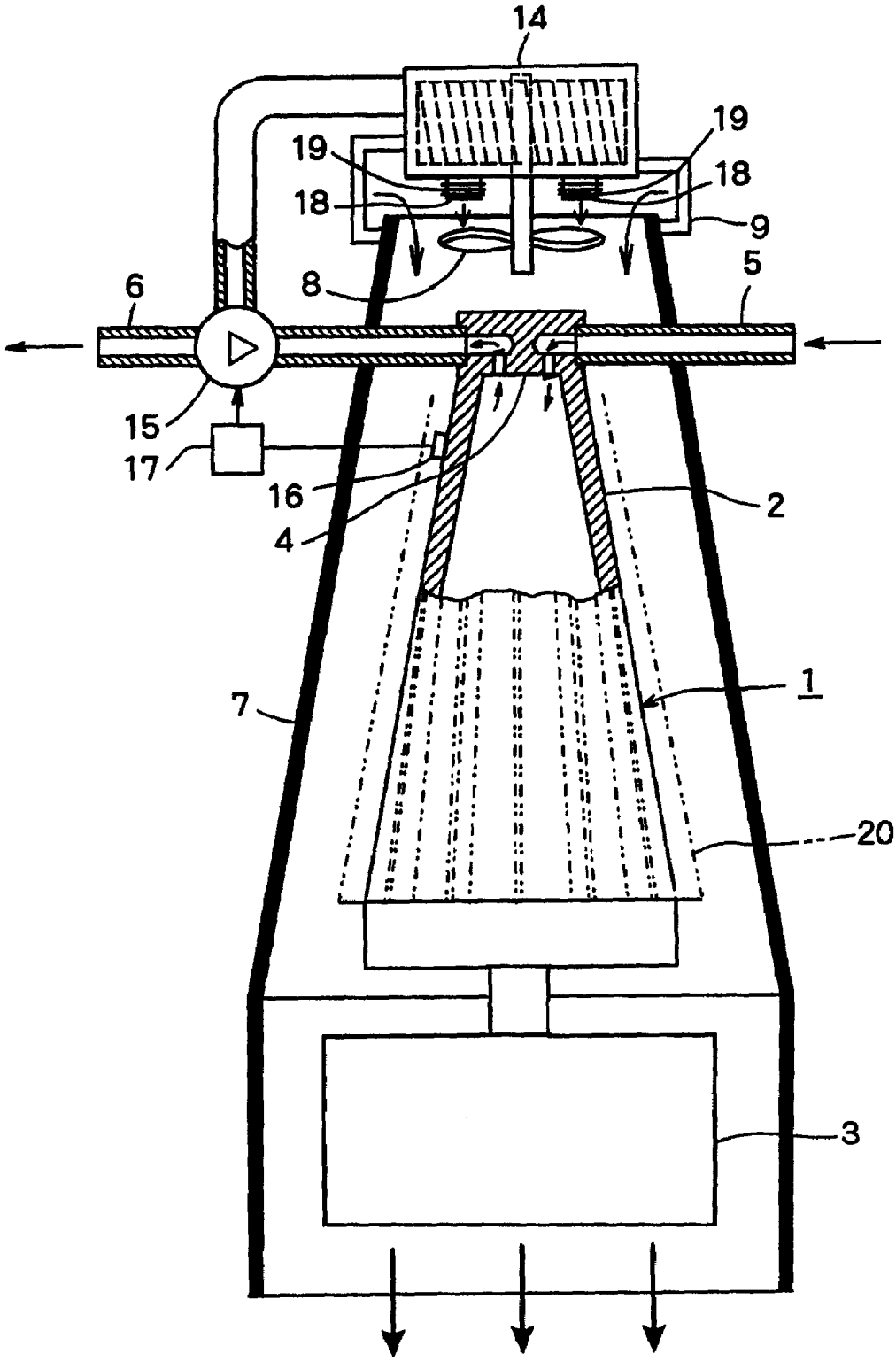
FIG. 7 is a vertical sectional front view of a yet further embodiment of an acoustic fluid machine according to the present invention.

In FIGS. 6 and 7, a discharge pipe 18 of the compressed-air-actuating turbine 14 is allowed to open into the end of the acoustic resonator 2 to enable the valve device 4 to be cooled more properly. As shown in FIGS. 6 and 7, discharged air into the acoustic resonator 2 may be preferably cooled by a cooling fin 19 of the discharge pipe 18 or other means.

In any of FIGS. 1 to 7, air sucked through the top end of the gas guide 7 is allowed to blow toward the valve device 4 and discharged from the rear end of the gas guide 7.

As shown in FIG. 6, a heat-radiating fin 20 may be provided to equalize radiated heat and promote radiation on the outer circumferential surface of the acoustic resonator 2.

The foregoing merely relates to embodiments of the present invention. Various changes and modifications may be made by a person skilled in the art without departing from the scope of claims.

What is claimed is:

1. An acoustic fluid machine comprising:

an acoustic resonator;

an actuator in a larger-diameter base end of the acoustic resonator to allow a piston to reciprocate at very small amplitude axially at high speed;

a valve device at a top end of the acoustic resonator to suck fluid and discharge it from the acoustic resonator according to pressure fluctuation in the acoustic resonator involved by reciprocating motion of the piston;

a gas guide that covers the acoustic resonator with a space and opens at a base end;

a fan at a top end of the gas guide to forward fluid to cool the valve device to reduce temperature gradient between a base and a top end of the acoustic resonator; and a compressed-air-actuating turbine that drives the fan by forwarding the fluid discharged from the acoustic resonator via the valve device.

2. An acoustic fluid machine of claim 1, further comprising a regulating valve for regulating fluid from the acoustic resonator, degree of opening of the regulating valve being controlled by a temperature sensor on the acoustic resonator.

3. An acoustic fluid machine of claim 1 wherein fluid discharged from the compressed-air-actuating turbine is forwarded into the acoustic resonator for cooling.

4. An acoustic fluid machine of claim 1 wherein fluid forwarded into the acoustic compressor is cooled by a cooling fin of the compressed-air-actuating turbine.

* * * * *